United States Patent [19]

Harrington

[11] 4,267,683

[45] May 19, 1981

[54] COUPLING MECHANISM FOR CAPPING MACHINE CHUCK

[75] Inventor: Shelby A. Harrington, Snyder, N.Y.

[73] Assignee: A-T-O Inc., Willoughby, Ohio

[21] Appl. No.: 98,518

[22] Filed: Nov. 29, 1979

[51] Int. Cl.[3] ..... B67B 3/20; B65B 7/28

[52] U.S. Cl. ..... 53/331.5

[58] Field of Search ..... 53/331.5, 317, 334; 279/1 J

[56] References Cited

U.S. PATENT DOCUMENTS

| | | | |
|---|---|---|---|
| 3,031,822 | 5/1962 | Dimond | 53/331.5 X |
| 3,303,633 | 2/1967 | Wilhere | 53/317 X |
| 4,178,733 | 12/1979 | Dankert | 53/331.5 |

*Primary Examiner*—Horace M. Culver

*Attorney, Agent, or Firm*—Christel, Bean & Linihan

[57] ABSTRACT

A coupling mechanism for interconnecting a drive spindle and a capping chuck, the mechanism including a coupling hub internally threaded for fastening to the spindle. A collar is disposed around the hub, and the hub has an arcuate groove in which a spring is positioned and retained by a removable plate. The hub has lugs integral therewith extending into receiving slots in a floating ring positioned in the collar below the hub. The floating ring is elliptically shaped for lateral movement relative to the collar along a first axis, and has feet integral therewith extending into keyways in a coupling member laterally movable relative to the ring along a second axis right angularly related to the first axis. The coupling member drives a chuck sleeve through a torsion spring to release the closure upon achieving a predetermined degree of tightness on a container.

10 Claims, 10 Drawing Figures

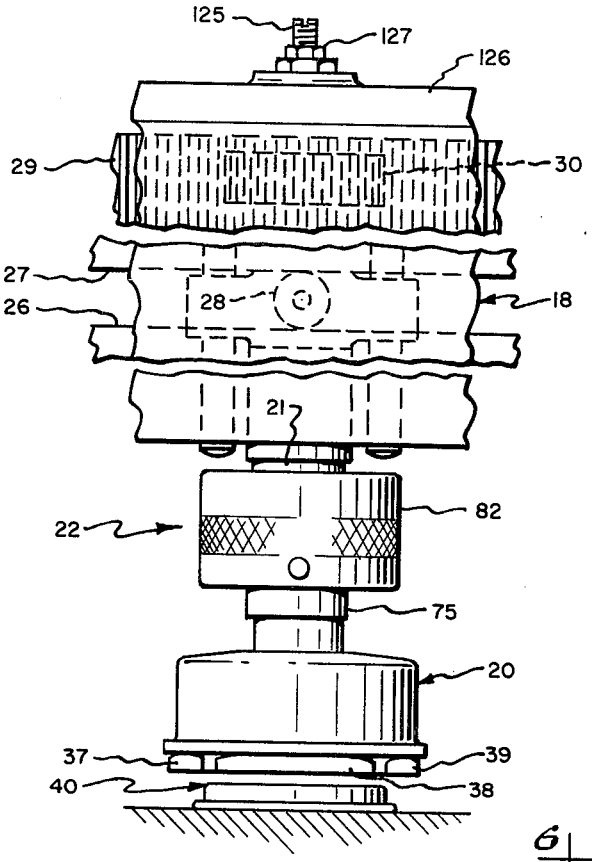
Fig. 1.
Fig. 2.
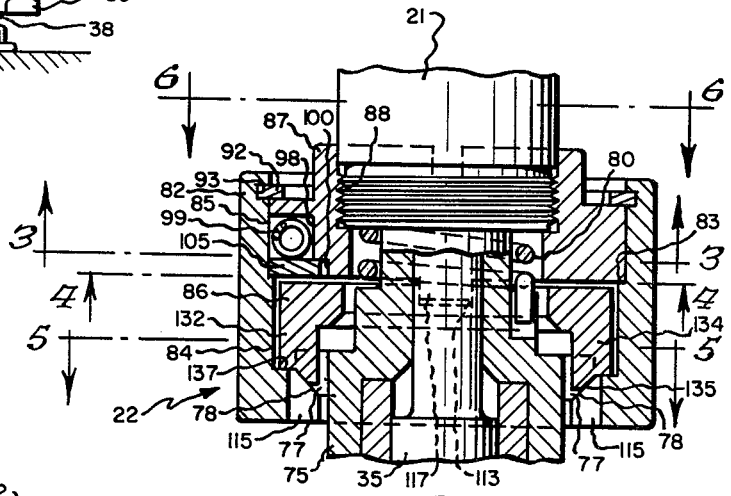
Fig. 3.
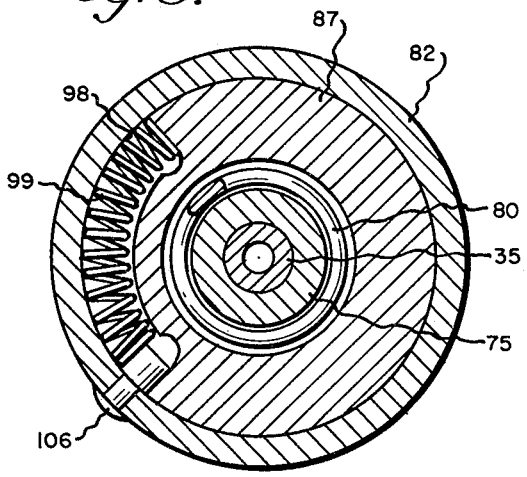
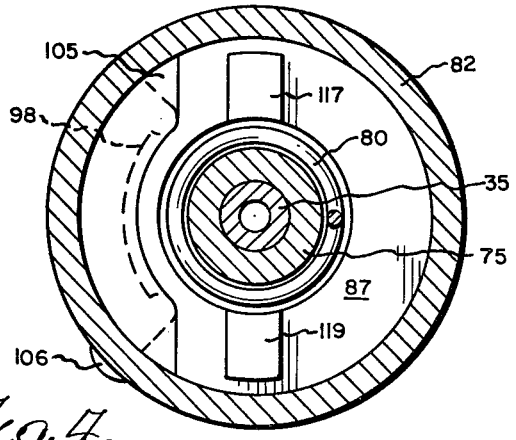
Fig. 4.

Fig. 5.
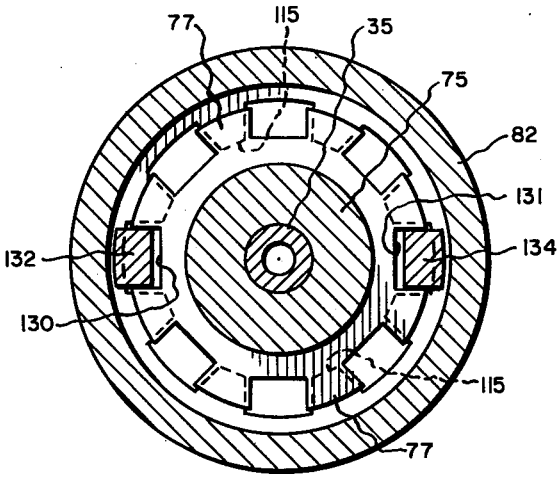
Fig. 6.
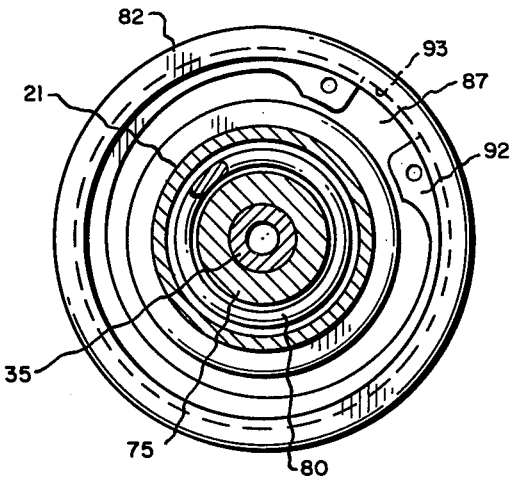
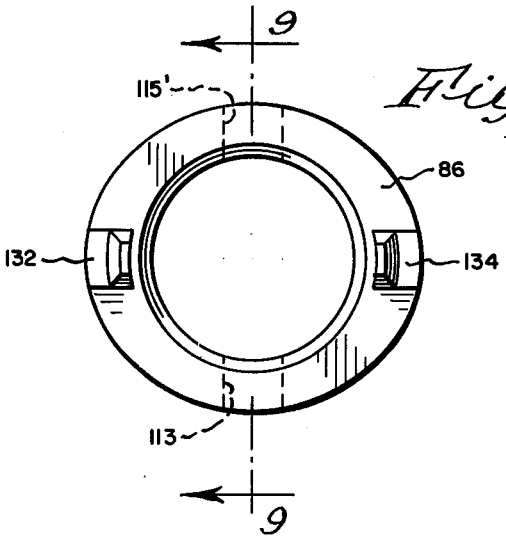
Fig. 7.
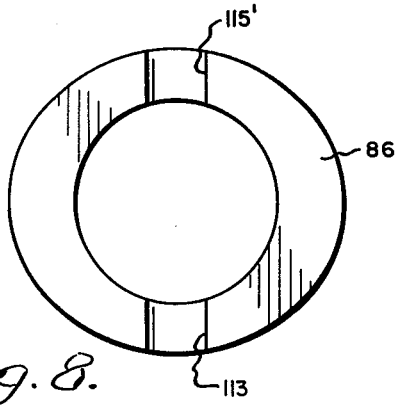
Fig. 8.
Fig. 9.
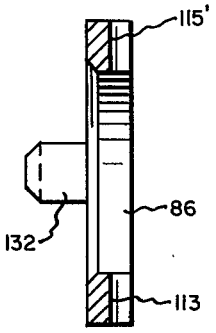
Fig. 10.
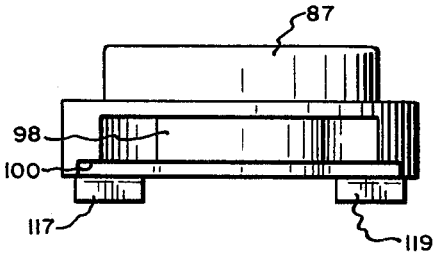

COUPLING MECHANISM FOR CAPPING MACHINE CHUCK

BACKGROUND OF THE INVENTION

This invention relates generally to the coupling art, and more specifically to certain new and useful improvements in a coupling mechanism for interconnecting a drive spindle and a capping chuck in apparatus for applying screw-type closure elements on successive containers with a predetermined degree of tightness. An example of such apparatus is shown in U.S. Pat. No. 3,031,822, issued May 1, 1962 in the name of George H. Diamond, entitled Chuck for Capping Machines.

In the closure-applying apparatus of U.S. Pat. No. 3,031,822 the coupling mechanism includes a hub fastened to a drive spindle, a pair of drive pins carried by the hub, a collar containing the hub and a floating ring driven by the pins. The floating ring carries a pair of lugs engaging keyways in a coupling member which drives a chuck sleeve through a torsion spring. When the closure has been applied to the container with the preselected degree of tightness, the torsion force of the spring is overcome and the coupling member is rotated relative to the chuck sleeve to a position causing the chuck jaws to open. Thereafter, the chuck sleeve and coupling member are reset.

During such resetting, the lugs on the floating ring and the pins on the hub are subjected to impact forces by associated parts of the mechanism due to the spring torsion force used in the mechanism. With larger size closures, the spring torsion force required to achieve the desired degree of tightness increases markedly. For example, a 28 mm cap might require only 18, whereas a 120 mm cap might require 95 inch lbs. of torque. The increased torque can substantially increase the impact forces on the pins and lugs during the resetting action to a point where such forces can become destructive of the mechanism.

In addition, a second spring is positioned within a hub groove to maintain the coupling hub and collar in predetermined orientation, the collar being rotatable against the bias of the second spring to release the coupling member from the mechanism. Heretofore, the second spring has been assembled by insertion through a slot in the collar, with a stud in the hub engaging one end of the slot to maintain the assembled relation.

SUMMARY OF THE INVENTION

The primary object of this invention is to provide a coupling hub and floating ring designed to withstand the resetting impact of significantly higher torsion forces applied repeatedly over a long period of use.

Another object of this invention is to provide the foregoing in a coupling mechanism retaining the advantages of the prior apparatus and characterized by its relative simplicity and ease of fabrication and assembly.

In one aspect thereof the coupling mechanism of this invention is characterized by the provision of a coupling hub having spanner lugs formed integrally therewith, and a floating ring slotted to receive the spanner lugs and also having lugs formed integrally with the ring for engaging keyways in the coupling member, the integral construction of the hub and ring with their respective lugs providing substantial reinforcement to better withstand the impact forces upon resetting.

In another aspect thereof the coupling mechanism of this invention is characterized by the provision of a coupling hub grooved to contain the second spring for maintaining the orientation of the hub and collar, with a retainer plate closing an access opening through the bottom of the hub.

The foregoing and other objects, advantages and characterizing features of this invention will become apparent from the ensuing detailed description of an illustrative embodiment thereof, in conjunction with the accompanying drawings wherein like reference numerals denote like parts throughout the various views.

BRIEF DESCRIPTION OF THE DRAWING FIGURES

FIG. 1 is a fragmentary, side elevational view, with portions broken away, of a capping machine incorporating a coupling mechanism of the present invention;

FIG. 2 is a longitudinal sectional view, partly in elevation, of the assembled coupling mechanism shown in FIG. 1;

FIG. 3 is a transverse sectional view taken about in line 3—3 of FIG. 2;

FIG. 4 is a transverse sectional view taken about on line 4—4 of FIG. 2;

FIG. 5 is a transverse sectional view taken about on line 5—5 of FIG. 2;

FIG. 6 is a transverse sectional view taken about on line 6—6 of FIG. 2;

FIG. 7 is a bottom plan view showing the floating ring of the coupling mechanism;

FIG. 8 is a top plan view of the floating ring;

FIG. 9 is a transverse sectional view thereof taken about on line 9—9 in FIG. 7; and FIG. 10 is a side elevational view showing the coupling hub.

DESCRIPTION OF THE PREFERRED EMBODIMENT

While not limited thereto, the coupling mechansim of this invention is shown incorporated in closure-applying apparatus of the type disclosed in U.S. Pat. No. 3,031,822, which being fully disclosed therein, is described only briefly herein. The coupling mechanism, indicated generally at 22 and described in detail hereafter, supports a cappping chuck 20 at the lower end of a vertically disposed hollow spindle 21. The illustrated chuck 20 has three jaws 37, 38 and 39 and is moved through an arcuate path during which it picks up a screw-type closure such as cap 40, screws cap 40 on a container (not shown) with a preselected degree of tightness, and then releases the cap and container.

Spindle 21 is reciprocably movable along its axis in suitable bearings (not shown), carried by spindle plates (also not shown) forming part of the capping machine turret 18. The reciprocable motion of spindle 21 is controlled by a lower cylindrical cam 26 and, if desired, an upper cylindrical holding cam 27 which are concentric with the machine turret 18, lower cam 26 being operatively engaged by a roller follower 28 mounted on the spindle. In addition, spindle 21 is constantly rotated about its axis, as it is rotated about the turret axis, by a normally stationary gear 29 meshing with a spur gear 30 fixed to the spindle 21.

Capping chuck 20 includes an elongated sleeve 35 which extends upwardly into spindle 21, as shown in FIG. 2. Spindle 21, coupling mechanism 22, and chuck 20 are movable relative to an axially stationary rod 125 which extends upwardly from within chuck sleeve 35 and is fixed at its upper end to a turret top plate 126, as by a nut 127. Rod 125 is adapted to be engaged by a stripper rod (not shown) for opening jaws 37—39.

A coupling member 75, substantially in the form of a hollow cylinder, extends around sleeve 35 and is provided with a series of radial, outwardly projecting bayonet lugs 77 which are equally spaced circumferentially of member 75. Each lug 77 has an inclined, upwardly extending lower surface 78 adapted to seat on the correspondingly inclined upper surfaces of lugs 115 spaced apart around the lower, inner periphery of coupling collar 82, as shown in FIG. 2. One end of an elongated coil spring 80 is mounted in a mating slot in coupling member 75 immediately above bayonet lugs 77. Spring 80 is disposed around member 75 and chuck sleeve 35 and is fixedly secured at its opposite end to sleeve 35, whereby member 75 is drivingly connected to chuck sleeve 35 through torsion spring 80 which is precompressed to provide the torsion required for chuck 20 to carry out its capping function.

For a more detailed description of the foregoing apparatus, reference is made to U.S. Pat. No. 3,031,822, the disclosure of which is hereby incorporated by reference.

The present invention is directed to the coupling mechanism which comprises a collar 82 having circular chambers 84 and 85 in which a floating ring 86 and a coupling hub 87, respectively, are positioned. Coupling hub 87 is internally threaded at 88 to engage external threading on the lowermost portion of spindle 21 and thereby maintain hub 87 and spindle 21 in fixed relationship with each other. Chamber 85 is of slightly greater diameter than chamber 84, providing an annular step or shoulder 83 on which hub 87 is seated within collar 82. A split retaining ring 92, spring-biased outwardly for retention in a groove 93 in collar 82, rests on the upper surface of hub 87 to releasably retain it within chamber 85.

A pair of diametrically opposed lugs 117 and 119 depend from hub 87, being formed integrally therewith, and are received in slots 113 and 115' formed in the upper surface of ring 86, thereby providing a rotary drive connection between hub 87 and ring 86. A pair of diametrically opposed feet 132 and 134 depend from ring 36, being formed integrally therewith, and seat on the annular flange 137 behind lugs 115 at the lower end of collar 82, thereby supporting ring 86 in chamber 84. Feet 132, 134 also extend into diametrically opposed keyways 130, 131 between lugs 77 on coupling member 75, and themsleves comprise lugs providing with lugs 77 a rotary drive connection between ring 86 and coupling member 75. Inwardly of flange 137, and in normally spaced relation thereto, the lower portion of lugs 132, 134 extend downwardly into keyways 130,131, as shown at 135, to provide additional drive lug material between lugs 77. The lower extremeties 135 of ring lugs 132, 134 are truncated, being inwardly and downwardly inclined on opposite sides thereof and from the flange engaging horizontal seat thereof, as shown in FIGS. 2, 7 and 9.

Chamber 84 is below and axially slightly longer than chamber 85. Floating ring 86 is elliptically shaped, as shown in FIGS. 7 and 8 with the major diameter thereof only slightly less than the diameter of chamber 84. Slots 113 and 115' are on the minor axis of the ellipse, and feet 132 and 134 are on the major axis thereof.

In operation, during the capping operation, the spindle 21 is constantly rotated about its axis, to similarly rotate capping chuck 20 through coupling mechanism 22.

After a container cap 40 is picked up by chuck 20 the apparatus moves toward a container (not shown) positioned therebeneath, and the cap 40 engages the threaded upper end thereof. The container is held against rotary movement by suitable means (not shown), while spindle 21 is rotated about its axis to similarly rotate coupling hub 87, member 75, coil spring 80, sleeve 35, chuck 20 and cap 40 gripped thereby. These components rotate in a clockwise direction to screw the cap onto the container.

As the container cap 40 is tightened onto the container, the resistance to rotation of the chuck increases. During the initial portion of the cap-applying operation this resistance is overcome by the torsion in spring 80, and the chuck continues to screw the cap in place. When cap 40 has been applied to the container with a predetermined degree of tightness, determined by the amount of torsion in spring 80, the rotational movement of chuck 20, and sleeve 35 is arrested. However, spindle 21, coupling hub 87, ring 86 and member 75 continue to rotate in a clockwise direction against the torsion of spring 80, whereupon relative movement occurs between coupling member 75 on the one hand and chuck sleeve 35 on the other. During this period, the apparatus operates in the manner previously disclosed to move the jaws to their open postion, thereby releasing the cap and the container, and to thereafter release the parts to be reset under the influence of spring 80.

During resetting, the coupling mechanism is subjected to the spring torque plus an impulse force, because spring 80 snaps the parts back into position. This imparts a substantial impact force against drive lugs 117 and 119 of hub 87, and drive lugs 132 and 134 of ring 86. It is a particular feature of this invention that these parts are capable of withstanding such forces, even under high torque loading, repeatedly over a long period of time. This is accomplished by the provision of lugs 117, 119 integral with hub 87, and feet 132, 134 integral with ring 86, whereby such lugs and feet are reinforced by the hub and ring material, in both directions. In addition, lugs 117, 119 and feet 132, 134 are flat sided and of substantial rectangular cross-sectional area, to better enable them to withstand the combined effects of torque and impulse at higher torque operating requirements. Lugs 117, 119 are wide and long, extending from the inner bore of hub 87 to just short of the ring chamber wall. Lugs 132, 134 also are wide, and of substantial radial and axial length.

Integrally forming spanner lugs 117, 119 on coupling hub 87 and integrally forming feet 132, 134 on floating ring 87 has the added advantage that these parts are easier and less expensive to manufacture and assemble, as compared with the use of separate pins and lugs which must be fastened to the hub and ring.

The elliptical floating ring 86 enables lateral movement of chuck 20 relative to spindle 21, to accomodate situations where containers being capped vary in their orientation relative to spindle 21. Ring 86 can move within collar 32 relative to hub 87 along its minor axis, and coupling member 75 can move relative to ring 86 along its major axis. Thus, in cases where a container is slightly out of line with the descending spindle, the chuck moves laterally as the gripped cap engages the container to properly align the cap therewith. The elliptical shape of ring 86 enables this to be accomplished with a collar diameter only slightly greater than the major dimension of ring 86, for economy in size.

An arcuate groove 98 is cut into the outer cylindrical surface of hub 87 and extends around the hub periphery for approximately one hundred degrees, as shown in FIG. 3, to accomodate a coil spring 99. Groove 98 is open through the bottom of hub 87, to provide an access opening which is closed by a removable retainer plate 105 having an arcuate shape and positioned to support spring 99 within groove 98. The bottom of hub 87 is recessed around groove 98, as shown at 100, to receive plate 105 which seats therein and on collar shoulder 83 in coplanar relation to the bottom of hub 87, as shown in FIG. 2. As shown in FIG. 3, one end of spring 99 butts against hub 87 at the corresponding end of groove 98, while the other end of spring 99 is in contact with a pin 106 which extends through collar 82 into groove 98 above retainer plate 105. Providing such an access opening facilitates assembly by permitting spring 99 to be inserted in collar 82 from above with one end against pin 106 and the other positioned in groove 98, and then slipping hub 87 into place within chamber 85. With this arrangement, spring 99 biases collar 82 in a counterclockwise direction, as viewed in FIG. 3, relative to hub 87, to maintain the coupling assembled. Rotating hub 87 relative to collar 82, against the bias of spring 99, aligns lugs 77 with the keyways between lugs 115, permitting coupling member 75 to drop out of the collar 82.

It is therefore apparent that the present invention accomplishes its intended objects. While a single embodiment of the present invention has been described in detail, this is for the purpose of illustration, not limitation.

I claim:

1. In an apparatus for applying a screw-type closure element to a container, the apparatus having a rotary drive spindle adapted to be disposed above a container, a chuck sleeve, and a coupling mechanism interconnecting said spindle and said sleeve, said coupling mechanism including a floating ring, a coupling hub, and means providing a drive connection between said coupling hub and said floating ring, the improvement comprising:

said means providing a drive connection between said coupling hub and said floating ring comprising lugs formed integrally with said coupling hub and extending below said coupling hub, and said floating ring having recesses receiving said lugs.

2. Apparatus according to claim 1, wherein each of said lugs is rectangular in cross-section and each of said recesses is in the form of a slot dimensioned to receive a corresponding one of said lugs.

3. In an apparatus for applying a screw-type closure element to a container, the apparatus having a rotary drive spindle adapted to be disposed above a container, a chuck sleeve, and a coupling mechanism interconnecting said spindle and said sleeve, said coupling mechanism including a floating ring, a coupling member connected to said sleeve by a torsion spring, and means providing a drive connection between said floating ring and said coupling member, the improvement comprising:

said means providing a drive connection between said floating ring and said coupling member comprising feet formed integrally with said floating ring, said feet projecting into keyways defined by the coupling member.

4. An apparatus as defined in claim 3, said feet being chamfered.

5. An apparatus for applying a screw-type closure element to a container, the apparatus having a rotary drive spindle adapted to be dispoed above a container, a chuck sleeve and a coupling mechanism interconnecting said spindle and said sleeve, said coupling mechanism including:

(a) a collar having an interior chamber;

(b) a coupling hub secured to said spindle and extending into said housing from one end thereof;

(c) a floating ring within said housing chamber;

(d) means providing a drive connection between said coupling hub and said floating ring comprising lugs formed integrally with said coupling hub and recesses in said floating ring located and shaped to receive said lugs;

(e) a coupling member drivingly associated with said sleeve;

(f) means providing a drive connection between said floating ring and said coupling member comprising feet formed integrally with said floating ring and keyways defined by said coupling member receiving said feet.

6. Apparatus according to claim 5, wherein each of said lugs is rectangular in cross-section and each of said recesses is in the form of a slot.

7. Apparatus according to claim 5, said ring being elliptical with said feet located on its major axis and said recesses located in its minor axis.

8. Apparatus according to claim 5, further indluding:

(a) an arcuate groove formed in said coupling hub;

(b) a spring positioned between said collar and said coupling hub within said groove;

(c) an access opening through the bottom of said coupling hub to said groove; and (d) a removable retainer element holding said spring in operative position within said groove;

(e) said collar being rotatable relative to said hub against the bias of said spring to release said coupling member from said mechanism.

9. Apparatus according to claim 5, wherein said spindle is hollow and vertically reciprocable, said coupling member surrounds said sleeve and projects therewith into said spindle, and said coupling member has a torsion spring drive connection to said sleeve.

10. In an apparatus for applying a screw-type closure element to a container, the apparatus having a rotary drive spindle adapted to be disposed above a container, a chuck sleeve, and a coupling mechanism interconnecting said spindle and said sleeve, said coupling mechanism including a collar, a coupling hub having an arcuate groove, and a spring positioned between said collar and coupling hub within said groove, said collar being rotatable relative to said hub against said spring to release said sleeve from said mechanism, the improvement comprising:

an access opening through the bottom of said coupling hub to said groove, and removable retainer plate normally holding said spring in operative position within said groove.

* * * * *